US005398418A

United States Patent [19]

Jones

[11] Patent Number: 5,398,418

[45] Date of Patent: Mar. 21, 1995

[54] GOLF COURSE HANDICAP CONVERTER

[76] Inventor: K. Tom Jones, 8101 N. Central #2, Phoenix, Ariz. 85020

[21] Appl. No.: 975,722

[22] Filed: Nov. 13, 1992

[51] Int. Cl.[6] ..... A63B 57/00; G06C 3/00

[52] U.S. Cl. ..... 33/1 SD; 235/886; 273/32 R; 273/32 B; 273/32 H; 273/162 A; 116/223; 116/225; 434/252

[58] Field of Search ..... 33/1 SD, 1 SB, 1 B; 273/87 R, 32 R, 176 L, 32 B, 32 H, 162 A, 162 R; 434/252; 116/223, 225; 235/88 G, 61 PD

[56] References Cited

U.S. PATENT DOCUMENTS

| | | | |
|---|---|---|---|
| 1,528,944 | 3/1925 | Newell | 33/1 SD |
| 2,393,922 | 1/1946 | McDowell | 33/1 SD |
| 2,747,795 | 5/1956 | Kreuttner | 33/1 B |
| 2,972,810 | 2/1961 | Davis | 33/1 SB |
| 3,037,285 | 6/1962 | Flowers et al. | 33/1 SB |
| 3,333,343 | 8/1967 | Elfast, Jr. | 33/1 SB |
| 3,627,200 | 12/1971 | Sadler | 116/223 |
| 3,721,007 | 3/1973 | Banner | 33/1 SD |
| 4,120,091 | 10/1978 | Borgato | 33/1 SD |
| 4,327,497 | 5/1982 | Wyatt, Sr. | 33/1 SD |
| 4,941,264 | 7/1990 | Poirier | 33/1 SD |

*Primary Examiner*—Christopher W. Fulton
*Attorney, Agent, or Firm*—David G. Rosenbaum; Laura J. Zeman; K. Brooke Coleman

[57] ABSTRACT

A circular or bar-type slide rule made of a durable rigid material for converting a golf handicap index into a converted playing handicap based upon the slope rating of a golf course. A method for calculating a converted playing handicap by aligning the player's handicap index value on a first logarithmic scale, locating the golf course slope rate on a second logarithmic scale so that the aligned value of the converted playing handicap may be read on the first scale.

14 Claims, 2 Drawing Sheets

GOLF COURSE HANDICAP CONVERTER

BACKGROUND OF INVENTION

1. Field of Invention

This invention utilizes a logarithmic scale slide rule specifically used to convert a calculation used only in the game of golf and more particularly relates to a well defined and narrow field of usage of circular or bar type slide rules.

2. Description Of Prior Art

Heretofore slide rules for various purposes have become known though not as a tool used in converting a Handicap Index into a playing handicap.

Similarly various slide rule devices associated with the game of golf have become known such as mechanical devices called slide rules to calculate handicaps, not to be confused with a playing handicap which will be later discussed. Devices have become known that determine the total number of shots or strokes used for a particular hole or game, or to determine the nature of a particular club for a particular shot, or to determine the distance to a particular hole. Logarithmic scale slide rule devices, however, in the nature of converting Handicap Indexes into course handicaps have not become known.

The instant invention uses the simplicity of a slide rule to calculate the golfer's equation thus providing three valuable services, 1. quick and accurate course handicaps and 2. equitable competition or a more true indication of how one plays on any particular day and 3. encourages more golfers to maintain a handicap, a major goal of the U.S.G.A.

SUMMARY OF INVENTION

My invention is comprised of three different embodiment devices using specific portions of logarithmic scales that when aligned properly using known Slope Ratings and Handicap Indexes, convert said Handicap Index into a course handicap. Golf handicaps have been used for many years, however very recently, the United States Golf Association (U.S.G.A.) developed a method of rating a golf course as to difficulty for the amateur golfer known as the Slope Rating of the course. Before the advent of the Slope System, it was difficult to determine what handicap a player used for any particular golf course. i.e. It is obvious that the same handicap should not be used when playing a "par 3" type course and a championship type course. Therefore, the Slope System was developed to rate the difficulty of a course and using a refined version of the "pre-slope" handicap calculations now known as a Handicap Index, one may use a simple calculation to convert the Handicap Index into a playing handicap, Slope Rating×Handicap divided by 113. Although simple in nature, difficult to do in one's head or long hand with paper and pencil.

Using my invention, a golfer knowing his/her Handicap Index aligns the "arrow" 03 shown in FIGS. 1 & 2 opposite the appropriate value on the portion of logarithmic scale known as the Handicap Index Scale 02 shown in FIGS. 1 & 2. Referring to the Slope Rating of the specific golf course and tees played, this value is located on another mating logarithmic scale known as the Slope Rating Scale 01 shown in FIGS. 1 & 2, and the "converted" course handicap is read opposite the Slope Rating Value and rounded up or down into a whole number. This value is the number of handicap strokes the player receives for that course/tee combination. This value will change each time a "different" Slope Rating course is played. Thus, every player may play with others on a fair and equitable level at any Slope Rated course throughout the world.

In providing such devices, it is the purpose of my invention to provide three different embodiments whose function are identical while providing a new and novel design, of rugged and durable nature, of simple and economic manufacture and devices otherwise well adapted to the uses and purposes for which they are intended. It is to be understood that the essential feature, the specific portion of the logarithmic scale may not be altered, however the structural embodiment may be modified from time to time as needed with three preferred and practical embodiments being illustrated in the accompanying drawings as required.

BRIEF DESCRIPTION OF DRAWINGS

In the accompanying drawings which form a part of this specification and wherein like numbers of reference refer to similar parts throughout.

DESCRIPTION OF PREFERRED EMBODIMENTS

Figure 3:
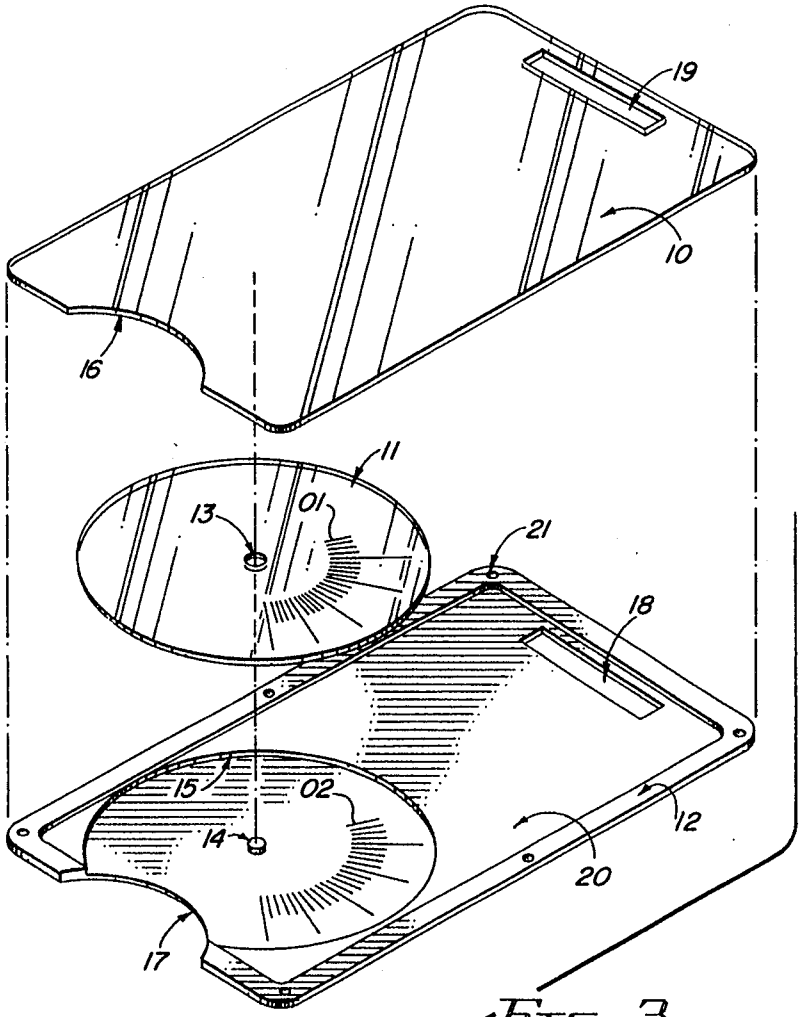
FIG. 3 is an expanded isometric view of the various elements of the first embodiment of my invention showing their configuration and relationship.

Referring now to the drawings in more detail and particularly to that of FIG. 3 and embodiment number 1, it will there be seen that my invention is comprised of three structural components; generally a back cover 10 that is located and fastened to the face plate 12 via six small tapered pins that are received into mating tapered holes 21 in face plate 12. Said face plate 12 is constructed so that it has a circular recess 15 with close manufacturing tolerances in which a movable circular disk 11 also with close manufacturing tolerances may rotate centered by a circular hole 13 and mating pin 14 on face plate 12 having no more than five thousands of an inch clearance.

Back cover 10 is constructed of a substantially rugged clear material in order that a picture or advertisement may be seen clearly. The picture or advertisement is located by a shallow recess 20 in face plate 12.

Figure 1:
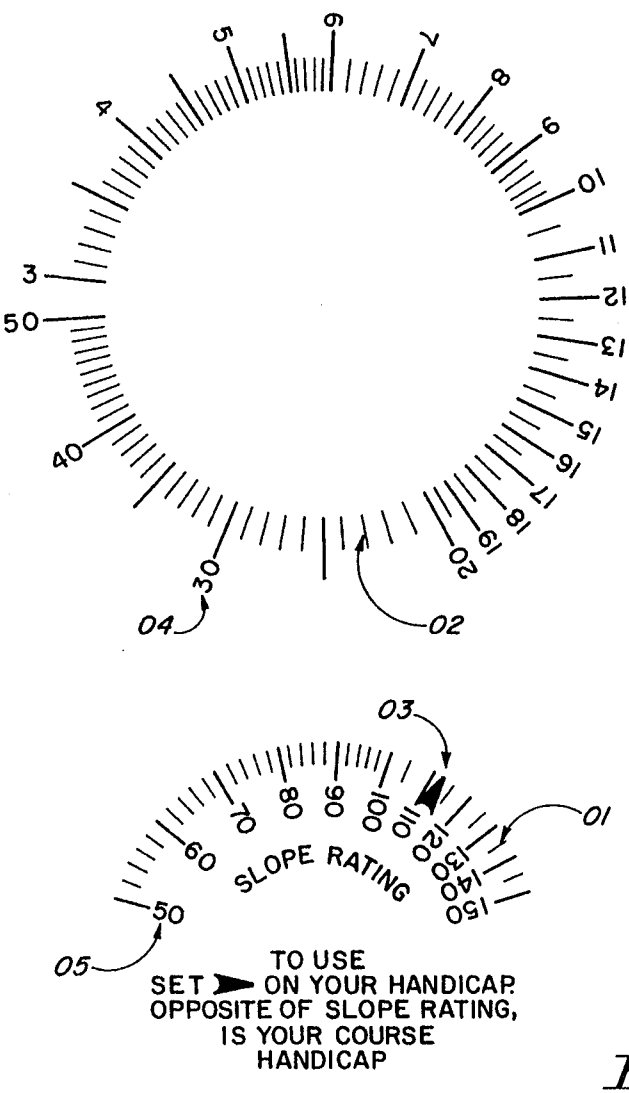
FIG. 1 is two circular mathematical scales, logarithmic based and specifically designed for use in my invention and particularly for the embodiment shown in FIG. 3 and FIG. 4.

Circular disk 11 is constructed of a substantially rugged clear material and the specific logarithmic scale FIG. 1 used in my invention is printed on the face of said circular disk 11.

A substantially rugged clear material is used in the construction of face plate 12 allowing the scale printed on said circular disk 11 to be read through the area circular recess 15 provides. A mating logarithmic scale FIG. 1 is printed or affixed to the inside of recess 15 in such a manner as to align with the mating scale on said circular disk 11.

Once assembled, back plate 10, circular disk 11, and face plate 12 form a device substantially known in the golf industry as a bag tag. A tag strap or other means of securing this device to a golf bag is passed through the mating strap holes 18 & 19 of the assembled device.

Figure 4:
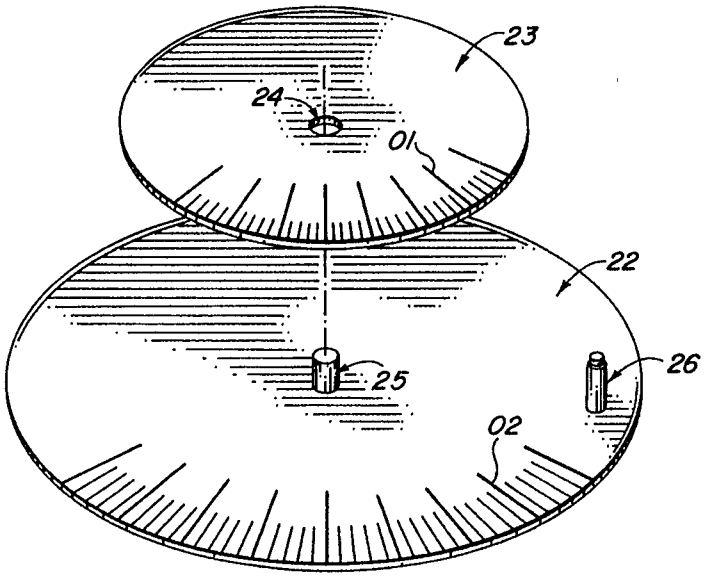
FIG. 4 is an expanded isometric view of the various elements of the second embodiment of my invention showing their configuration and relationship.

Referring to FIG. 4 and embodiment number 2, it will there be seen that my invention may be generally constructed of two structural components. Base plate 22 manufactured from substantially rugged material is circular in shape for ease of manufacturing but could be any other geometric shape. Centering pin 25 manufactured to close tolerances, plus or minus two thousands of an inch locates circular disk 23 having a close toleranced mating hole 24. Said circular disk 23 is constructed from substantially rugged material and a specific logarithmic scale shown in FIG. 1 is printed or affixed and located accurately upon the face. A mating logarithmic scale shown in FIG. 1 is printed or affixed to the face having the centering pin 25 of said base plate 22.

Assembly of the two components is secured by "mushrooming" the centering pin 25 which protrudes from said circular disk 23 with a heating iron or other means of accurately forming a head on said pin 25.

My invention may be attached to a golf bag or other objects using the afore mentioned bag strap passed through strap hole 26.

Figure 5:
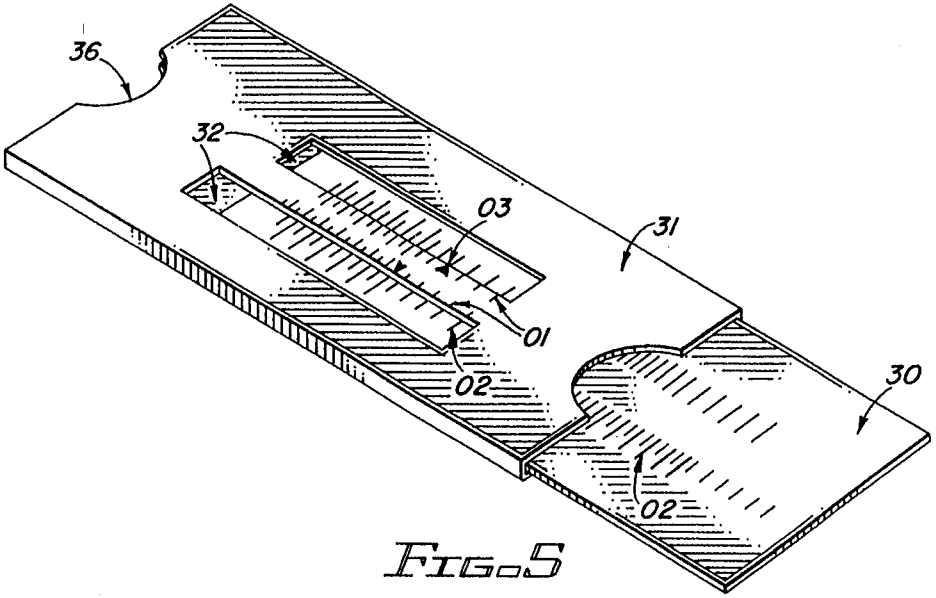
FIG. 5 is an isometric view of the third embodiment of my invention showing their configuration and relationship.

My invention may be embodied in another form as is apparent in FIG. 5. Slide cover 31 is constructed from substantially rigid material such as plastic or cardboard, printed with advertising on one side and having two windows 32 on the other. Said slide cover 31 is printed in a flat state and mechanically folded to form an enclosed case as shown in FIG. 5. Two portions of a specific logarithmic scale 01, also shown in FIG. 2 are printed accurately about said windows 32.

Figure 2:
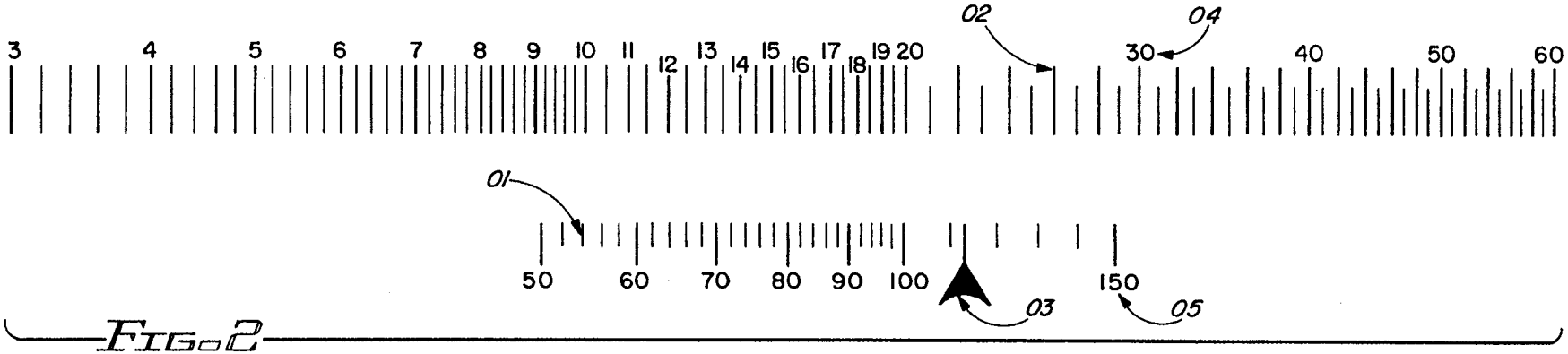
FIG. 2 are two mathematical scales, logarithmic based and specifically designed for use in my invention and particularly for the embodiment shown in FIG. 5

A slide 30 is constructed from substantially rigid material such as plastic or cardboard and has mating logarithmic scales 02, also shown in FIG. 2, printed on the face as to align with the scales 01 when inserted into slide cover 31.

The foregoing descriptions of my invention is necessarily of a detailed nature so that three specific embodiments of it might be set forth as required, but it is to be understood that various modifications of detail, shape and end use of my invention may be resorted to without departing from its spirit, essence or scope as long as the specific logarithmic scale relationship is maintained.

Having thusly described my invention, what I desire to protect by Letters Patent, and what I claim is:

1. A converter for calculating golf handicaps dependent on a known handicap value and a known golf course slope rating, comprising:

at least two substantially planar members;

a first fixed logarithmic scale having values from 3 to 60 demarcated on a first of said at least two planar members, said first fixed logarithmic scale corresponding to a golf handicap value;

a second fixed logarithmic scale having values from 50 to 150 demarcated on a second of said at least two planar members, said second fixed logarithmic scale corresponding to a golf course slope rating value;

an alignment indicia positioned at a value of 113 on said second fixed logarithmic scale; and means for movable cooperation of said at least two planar members relative to each other, whereby said second planar member having said alignment indicia is movable to position said alignment indicia in juxtaposition to a point on the first fixed logarithmic scale demarcated on the first planar member.

2. The converter of claim 1, wherein said at least two substantially planar members further comprise:

a back cover member having an interior surface and an exterior surface and a circular recess interposed on the interior surface, a cut-away formed along an edge of said back cover member and an aperture passing through said back cover member for passage of a strap;

a face plate member having an interior surface, an exterior surface, a plurality of edges defining a perimeter, a pin projected from the interior surface of said face plate, a cut-away formed along an edge of said face plate member and an aperture passing through said face plate member in alignment with said aperture passing through the back cover for passage of a strap;

a circular disc member positioned within said circular recess on the interior surface of said face plate member and projecting out of said cut-away on said face plate member and said back cover member; and fastening means for fastening said back cover member to said face plate member.

3. The converter of claim 2, wherein said first fixed logarithmic scale is positioned on an upper surface of said circular disc member and said second fixed logarithmic scale is positioned on the interior surface of said recess in said back cover member and visible relative to said first fixed logarithmic scale of the circular disc member.

4. The converter of claim 1, wherein said at least two substantially durable rigid members further comprise:

a circular base plate member having a radial dimension, a top surface, a bottom surface, and an aperture passing through said circular base plate member for passage of a strap; and a circular disc member having a radial dimension less than said radial dimension of said base plate member.

5. The converter of claim 4, wherein said circular disc member further comprises:

said first fixed logarithmic scale positioned on the top surface of said circular disc member.

6. The converter of claim 5, wherein said circular base plate member further comprises:

said second fixed logarithmic scale positioned on the top surface of said circular base plate member and visible relative to said first fixed logarithmic scale of said circular disc member.

7. The converter of claim 4 wherein the means for movable cooperation comprises:

a centering pin protruding from said top surface of said circular base plate member and an aperture passing through said circular disc member; and said centering pin and said aperture being in co-axial alignment.

8. The converter of claim 1, wherein said at least two substantially planar members further comprise:

a substantially rectangular slide cover forming an envelope and having upper and lower planar surfaces;

at least one of the upper or lower planar surfaces of said slide cover, having at least one substantially rectangular aperture formed thereon; and a substantially rectangular slide member insertable in sliding engagement within said slide cover.

9. The converter of claim 8, wherein said slide cover further comprises;

said first fixed logarithmic scale positioned in at least one portions accurately about said at least one aperture formed on said at least one planar side member of the slide cover; and said second fixed logarithmic scale positioned on said slide member in alignment with said first logarithmic scale when said slide member is inserted within said slide cover.

10. A converter for calculating golf handicaps dependent on a known handicap value and a known golf course slope rating, comprising:

a backing member, having an interior surface, an exterior surface, a plurality of edges defining a perimeter, a circular cut-away formed along an edge of said backing member, a first logarithmic scale corresponding to a golf course slope rating value in the range of 50 to 150, said first logarithmic scale further comprises an alignment indicia located about value 113, said first logarithmic scale being positioned on an upper surface of said backing member and an aperture passing through said back cover member for passage of a strap;

a face member having an interior surface, an exterior surface, a plurality of edges defining a perimeter, a pin projecting from the interior surface of said face member, a circular cut-away formed along an edge of said face member and an aperture passing through said face member in alignment with said aperture passing through said backing member for passage of a strap;

a circular disc member rotatably engaged on said pin projecting from the interior surface of said face member, said circular disc member having a second logarithmic scale positioned on an upper surface, said second logarithmic scale corresponding a golf handicap value in the range of 3 to 60;

fastening means for fastening said back cover member to said face member.

11. The converter of claim 10, wherein the means for fastening further comprises a plurality of tapered bores positioned in close proximity to said perimeter of at least one of said face member and said backing member and a plurality of pins positioned in close proximity to said perimeter of other said at least one of said face member and said backing member.

12. A converter for calculating golf handicaps dependent on a known handicap value and a known golf course slope rating, comprising:

a circular base member having a radial dimension, a top surface, a bottom surface, a centering pin protruding from said top surface, and an aperture passing through said base for passage of a strap;

a circular disc member having a radial dimension less than said radial dimension of said base member, and an aperture through said disc for receipt of said centering pin said circular disc member being freely rotatable about said centering pin;

a first fixed logarithmic scale positioned on the top surface of said circular disc member, said first fixed logarithmic scale corresponding to a golf course rating value in the range of 50 to 150 and further comprising an alignment indicia located about value 113;

a second fixed logarithmic scale positioned on the top surface of said circular base member and visible relative to said first fixed logarithmic scale of said circular disc member, said second fixed logarithmic scale corresponding to a golf handicap value in the range of 3 to 60.

13. The converter of claim 12, wherein said circular disc member and said circular base member further comprise fastening means for securing said circular disc member to said circular base plate.

14. A converter for calculating golf handicaps dependent on a known handicap value and a known golf course slope rating, comprising;

a rectangular slide cover forming an enclosed case, having upper and lower planar surfaces, at least one of the upper or lower planar surfaces of said slide cover, having at least one substantially rectangular aperture formed on said at least one planar surface;

a rectangular slide member insertable in sliding engagement within said slide cover;

a first fixed logarithmic scale positioned in at least one portion accurately about said at least one aperture formed on said at least one planar surface of the slide cover, said first fixed logarithmic scale corresponding to a golf course slope rating value in the range of 50 to 150 and further comprising an alignment indicia located about value 113;

a second fixed logarithmic scale positioned on said slide member in alignment with said first logarithmic scale when said slide member is inserted within said slide cover, said second fixed logarithmic scale corresponding to a golf handicap value in the range of 3 to 60.

* * * * *